US009765738B2

(12) United States Patent
Izzo et al.

(10) Patent No.: US 9,765,738 B2
(45) Date of Patent: Sep. 19, 2017

(54) FUEL INJECTOR

(71) Applicant: Continental Automotive GmbH, Hannover (DE)

(72) Inventors: Ivano Izzo, Pisa (IT); Marco Mechi, Vada (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 121 days.

(21) Appl. No.: 14/644,417

(22) Filed: Mar. 11, 2015

(65) Prior Publication Data

US 2015/0260135 A1 Sep. 17, 2015

(30) Foreign Application Priority Data

Mar. 14, 2014 (EP) ..... 14159680

(51) Int. Cl.

*F02M 51/06* (2006.01)
*F02D 41/40* (2006.01)
*F02D 41/24* (2006.01)

(52) U.S. Cl.

CPC ..... *F02M 51/061* (2013.01); *F02M 51/0664* (2013.01); *F02M 51/0685* (2013.01); *F02D 41/2467* (2013.01); *F02D 41/40* (2013.01); *F02M 2200/07* (2013.01); *F02M 2200/50* (2013.01)

(58) Field of Classification Search

CPC ..... F02M 51/061; F02M 51/0685; F02M 51/0664; F02M 2200/50; F02M 2200/07; F02D 41/2467; F02D 41/40

See application file for complete search history.

(56) References Cited

U.S. PATENT DOCUMENTS 4,774,485 A * 9/1988 Dietrich ..... H01H 51/2209 335/230
4,779,582 A * 10/1988 Lequesne ..... F01L 9/04 123/90.11

(Continued)

FOREIGN PATENT DOCUMENTS

DE 102009046474 A1 5/2011 ..... F02M 51/06
DE 102011089337 A1 6/2013 ..... F02M 47/02

(Continued)

OTHER PUBLICATIONS

European Search Report, Application No. 14159680.9, 6 pages, Sep. 5, 2014.

*Primary Examiner* — Joseph Dallo
(74) *Attorney, Agent, or Firm* — Slayden Grubert Beard PLLC

(57) ABSTRACT

A fuel injector includes a fuel valve with a valve seat and a movable valve needle, a calibration spring and an electromagnetic actuator with a solenoid and a movable armature. The calibration spring exerts a pressing force on the valve needle for pressing the valve needle in a closing direction towards the valve seat. When the solenoid is electrically energized, the electromagnetic actuator is operable to transfer a lifting force to the valve needle by engagement with the armature for lifting the valve needle from the valve seat to a fully open position against the pressing force of the calibration spring. The calibration spring and the electromagnetic actuator are configured such that the lifting force equals the pressing force in the fully open position.

18 Claims, 5 Drawing Sheets

(56) References Cited

U.S. PATENT DOCUMENTS 4,829,947 A * 5/1989 Lequesne ..... F01L 9/04 123/90.11
5,029,807 A * 7/1991 Fuchs ..... F16K 31/082 251/129.18
5,127,585 A * 7/1992 Mesenich ..... F02M 51/0614 239/585.3
5,521,446 A * 5/1996 Chalupa ..... H02K 41/0352 310/12.01
5,678,521 A * 10/1997 Thompson ..... F02M 63/00 123/446
6,457,457 B1 * 10/2002 Harcombe ..... F02D 41/20 123/490
6,808,133 B1 * 10/2004 Stier ..... F02M 51/0614 239/585.1
6,845,001 B1 * 1/2005 Kinbara ..... H01F 7/1844 361/152
8,166,953 B2 * 5/2012 Caley ..... F02D 41/20 123/490
2002/0053282 A1 * 5/2002 Duquette ..... F02M 59/102 92/12.2
2003/0062029 A1 * 4/2003 Oyama ..... F02D 41/20 123/490
2003/0062030 A1 * 4/2003 Oashi ..... F02D 41/08 123/496
2003/0169552 A1 * 9/2003 Seale ..... F01L 9/04 361/160
2004/0134468 A1 * 7/2004 Yamazaki ..... F02D 41/20 123/499
2008/0198529 A1 * 8/2008 Rembold ..... F02D 41/20 361/195
2008/0276907 A1 * 11/2008 Abe ..... F02D 41/20 123/472
2008/0296414 A1 * 12/2008 Kubota ..... F02M 51/0675 239/533.11
2012/0234299 A1 * 9/2012 Abe ..... F02D 41/20 123/490
2012/0261499 A1 * 10/2012 Dames ..... H01F 7/16 239/585.1
2012/0318883 A1 * 12/2012 Kusakabe ..... F02D 41/20 239/1
2013/0332048 A1 * 12/2013 Kim ..... F02M 61/10 701/103
2014/0110508 A1 * 4/2014 Dames ..... H01F 7/1646 239/585.1

FOREIGN PATENT DOCUMENTS

EP 2375036 A1 10/2011 ..... F02D 41/20
EP 2538061 A2 12/2012 ..... F02D 41/20
WO 2012/172351 A2 12/2012 ..... F02M 62/00

* cited by examiner

FUEL INJECTOR

CROSS-REFERENCE TO RELATED APPLICATIONS

This application claims priority to EP Patent Application No. 14159680 filed Mar. 14, 2014. The contents of which are incorporated herein by reference in their entirety.

TECHNICAL FIELD

The present disclosure relates to a fuel injector for injecting fuel into a combustion engine.

BACKGROUND

A fuel injector is configured to permit a flow of combustible liquid like fuel in response to an electrical signal. Advanced engine technology requires precise control over the opening and closing times of a fuel valve within the injector in order to perform high-precision injection. If the combustion engine is of the piston type, multiple injection phases during one stroke of one piston in one cylinder of the engine may be required. As members of the valve are bound to physical masses, practical behaviour of the valve may differ from idealized theoretical behaviour which may foresee infinitely high opening or closing velocities or a linear relationship between the pulse length of an electrical signal for opening the valve and an actual flow of liquid through the valve.

SUMMARY

One embodiment provides a fuel injector comprising a fuel valve, comprising a valve seat and a movable valve needle which cooperate for controlling a flow of fuel through the injector; a calibration spring; and an electromagnetic actuator comprising a solenoid and a movable armature, wherein the calibration spring exerts a pressing force on the valve needle for pressing the valve needle in a closing direction towards the valve seat; when the solenoid is electrically energized, the electromagnetic actuator is operable to transfer a lifting force to the valve needle by means of engagement with the armature for lifting the valve needle from the valve seat to a fully open position against the pressing force of the calibration spring, and wherein the calibration spring and the electromagnetic actuator are configured such that the lifting force equals the pressing force in the fully open position.

In a further embodiment, the armature is displaceable in an opening direction, opposite to the closing direction, from a start position to an end position for lifting the valve needle from a closing position to the fully open position and the armature is further displaceable in the opening direction from said end position.

In a further embodiment, the displacement of the armature between the start position and the end position is greater than 90 μm.

In a further embodiment, the calibration spring has a stiffness 400 N/mm or more.

In a further embodiment, fuel injector further comprises a stopper being situated such that the stopper is approached by the armature upon the opening motion of the armature, the stopper and the armature having facing surfaces that are parallel.

In a further embodiment, the surfaces are perpendicular to a direction of the opening motion of the armature.

In a further embodiment, a gap between the facing surfaces is hydraulically connected to a path of the fuel through the injector towards the valve.

In a further embodiment, the facing surfaces are separated from each other when the armature is in the end position.

In a further embodiment, the calibration spring comprises a spring sleeve.

BRIEF DESCRIPTION OF THE DRAWINGS

Example embodiments of the invention are explained below in more detail with reference to the drawings, in which.

DETAILED DESCRIPTION

Figure 1:
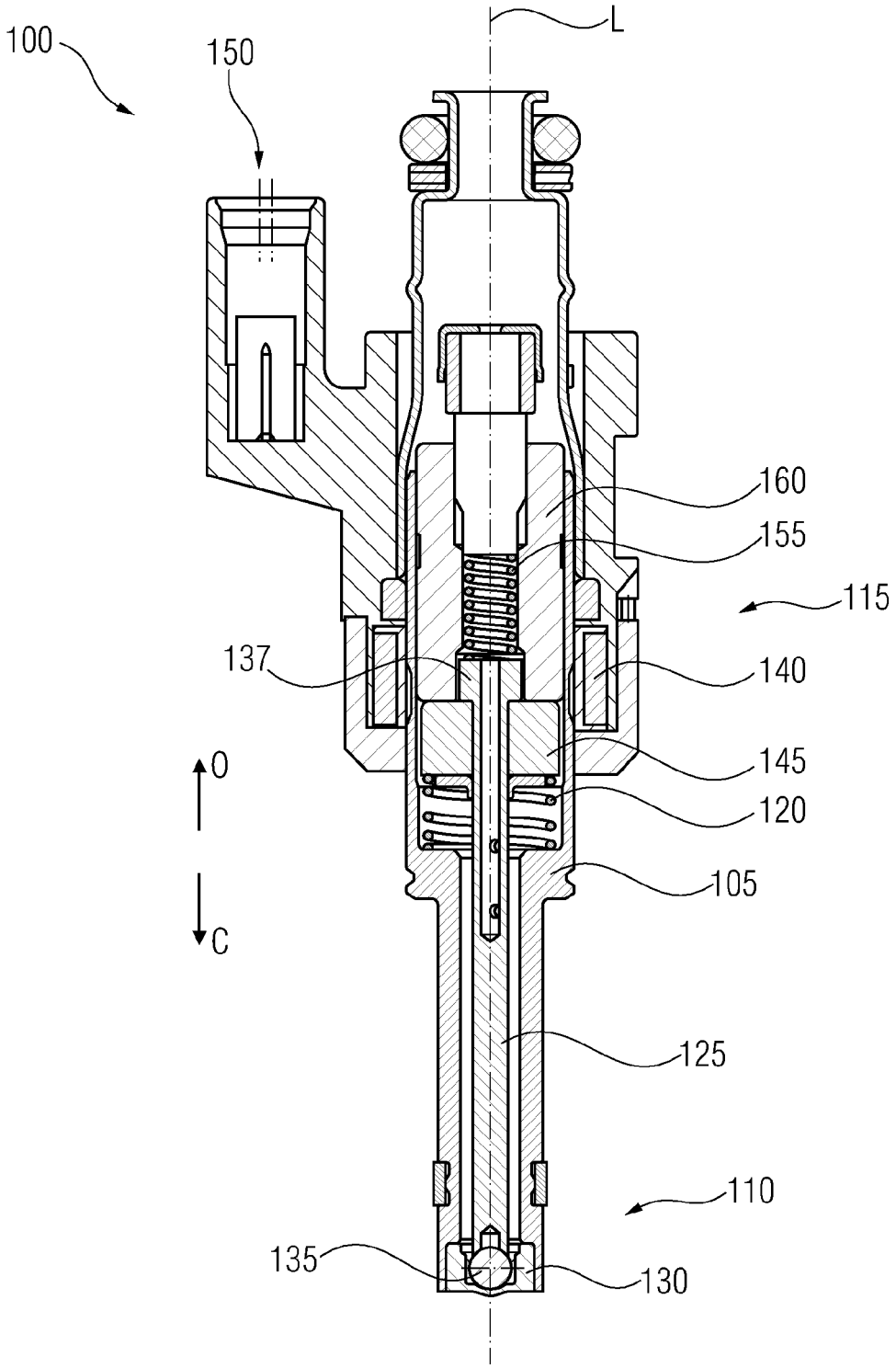
FIG. 1 shows a longitudinal section of a fuel injector.

Embodiments of the present invention provide a fuel injector with improved control over the flow of fuel during injection times.

According to one embodiment, a fuel injector comprises a fuel valve with a movable valve needle and a valve seat. The fuel injector further comprises a calibration spring and an actuator assembly, the latter being briefly denoted as "actuator" in the following.

The valve needle and the valve seat cooperate for controlling a flow of fuel through the injector. In particular, the valve needle prevents fuel flow through an injection nozzle of the fuel injector in a closing position where it is in particular in direct mechanical contact with the valve seat. Expediently, the valve needle may be axially displaceable with respect to the valve seat—away from the closing position along a longitudinal axis of the fuel injector—for enabling fuel flow through the injection nozzle.

The calibration spring exerts a pressing force on the valve needle for pressing the valve needle in a closing direction towards the valve seat. In particular the calibration spring is preloaded to bias the valve needle into contact with the valve seat for retaining the fuel valve closed when the actuator is de-energized.

The actuator is an electromagnetic actuator with a solenoid and a movable armature. Expediently, it may further comprise a pole piece towards which the armature is attracted when the solenoid is energized. The pole piece is in particular positionally fix relative to the valve seat while the armature is in particular longitudinally displaceable in reciprocating fashion with respect to the valve seat.

When the solenoid is electrically energized, the actuator is operable—in particular by means of mechanical engagement of the armature with the valve needle—to transfer a lifting force to the valve needle for lifting the valve needle from the valve seat to a fully open position against the pressing force of the calibration spring. In the present context the fully open position is in particular the position in which the valve needle comes to a rest when the actuator is energized to retain the fuel valve open after the opening transient during one injection event.

The calibration spring and the actuator are configured such that the lifting force equals the pressing force in the fully open position. In particular, the spring rate and the preload of the calibration spring and the inductance of the solenoid are adapted to one another such that the lifting force equals the pressing force in the fully open position.

With advantage, the pressing force—i.e. the spring force of the calibration spring—largely contributes to slowing down the armature at the end of the opening transient. The opening motion of the armature is stopped by the spring force of the calibration spring rather than by a stopper against which the armature impacts, the opening or closing motions of the armature can be controlled better. In particular, bouncing and/or non-linear behaviour at the end of the opening transient may be particularly small. A closing time of the valve may be smaller since there a magnetic and/or hydraulic sticking effect between the armature and the stopper is particularly small or even completely absent. The sticking effect may resist a motion of the armature away from the stopper in conventional injectors while fluid rushes into the expanding space between the two elements. According to the injector of the present disclosure, it can be avoided to reduce this space near zero at any time. Thus, fluid may more easily flow between the armature and another element, such as the pole piece which acts as the stopper in many conventional injectors.

In one embodiment, the armature is displaceable in an opening direction, opposite to the closing direction, from a start position to an end position for lifting the valve needle from the closing position to the fully open position. In other words, when the armature is in engagement with the valve needle so that is operable to transfer the lifting force to the valve needle, the valve needle is in the closing position when the armature is in the start position and the valve needle is in the fully open position when the armature is in the end position.

For example, the armature is fixed to the valve needle, e.g. by means of a press-fit connection and/or a welded connection, or the armature is in one piece with the valve needle. Alternatively, the armature may be longitudinally displaceable with respect to the armature in reciprocating fashion. In this case the armature and the valve needle are expediently shaped such that the displaceability is limited and the armature is in particular operable to engage into a form-fit connection with the valve needle for transferring the lifting force.

In one embodiment, the armature is further displaceable in the opening direction from the end position. In other words, the armature is spaced apart in the opening direction from any element of the fuel injector which is positionally fix with the valve seat. To put it differently, the armature is not in form fit connection with a stopper preventing further movement of the armature in the opening direction when it is in the end position. For example, the armature is operable to oscillate in longitudinal direction around the end position at the end of the opening transient. The oscillations of the armature may preferably be hydraulically damped; in this way, the armature and the valve needle quickly come to a rest at the end of the opening transient.

In one embodiment, a lift of the armature—i.e. in particular the longitudinal displacement of the armature—between the start position and the end position is larger than 90 μm. This may advantageously correspond to the lift of the armature being increased over some conventional injectors by roughly 10 to 25%. By increasing the armature lift, it is possible to reduce the nominal stiffness, i.e. in particular the spring rate, of the calibration spring which is necessary to achieve the force equilibrium of the lifting force and the pressing force in the fully open position. The lift increase may also help to reduce the sensitivity of the lift setting tolerance. In other words, by increasing the lift, the absolute position of the armature in the fully open position may be permitted a small deviation from a predetermined value.

In one embodiment, the calibration spring has a stiffness 400 N/mm or more. A conventional injector of a comparable type uses a calibration spring with a spring rate of about 50 N/mm. By increasing the stiffness by a factor of about eight or more, impact of the armature against the pole piece or another item in the way of travel of the armature can be avoided.

In another embodiment, the fuel injector further comprises a stopper being situated such that the stopper is approached by the armature upon the opening motion of the armature. In other words, the armature is displaced in the opening direction towards the stopper for lifting the valve needle from the valve seat to the fully open position. In one development, the stopper is represented by the pole piece.

The stopper and the armature have facing surfaces which are preferably parallel. In particular, the stopper has an end surface facing in the closing direction towards the armature and the armature has an end surface facing in the opening direction towards the stopper, the end surfaces being preferably parallel.

The parallel surfaces may act as a hydraulic damper when an ambient fluid such as fuel is displaced between the armature and the stopper when the armature approaches the stopper. The overlapping area content of the surfaces and a minimum distance between the armature and the stopper may be varied in order to adapt damping parameters. While, in conventional injectors, the surfaces of the stopper and the armature which face towards one another usually have to be inclined to reduce the hydraulic sticking effect, particularly good damping properties are achievable by means of the parallel surfaces.

The facing surfaces may be perpendicular to the closing direction. In particular, the surfaces are flat and have a surface normal which is parallel to the longitudinal axis. Since the opening motion of the armature is in particular (anti)-parallel to the closing direction, the facing surfaces may be used particularly efficiently for damping in the present embodiment.

A gap between the facing surfaces may be hydraulically connected to a path of the fuel flowing through the injector towards the valve. This permits the use of fuel flowing through the injector as a hydraulic damping medium. Damping may be improved with respect to a damper working on a gas and the fuel may help to remove heat originating from the damping process.

The facing surfaces are separate from one another when the armature is in the end position. Preferably, the facing surfaces are spaced apart from one another at all times during opening and closing of the armature.

By avoiding impact between the armature and the stopper, opening and closing responsiveness of the armature may be improved.

In one embodiment, the calibration spring comprises a spring sleeve or consists of a spring sleeve. For example, the spring sleeve is in the general shape of a cylinder shell, the cylinder shell being perforated in radial direction by a plurality of through-holes or by a plurality of slits, the slits preferably having a main extension direction perpendicular to the cylinder axis. In this way, high stiffness of the calibration spring may be easily achievable. The spring sleeve may provide high precision, low residual stress or low variation of spring rate. In other embodiments, different types of springs may be used for the calibration spring with some or all of the above-indicated advantages.

Figure 3:
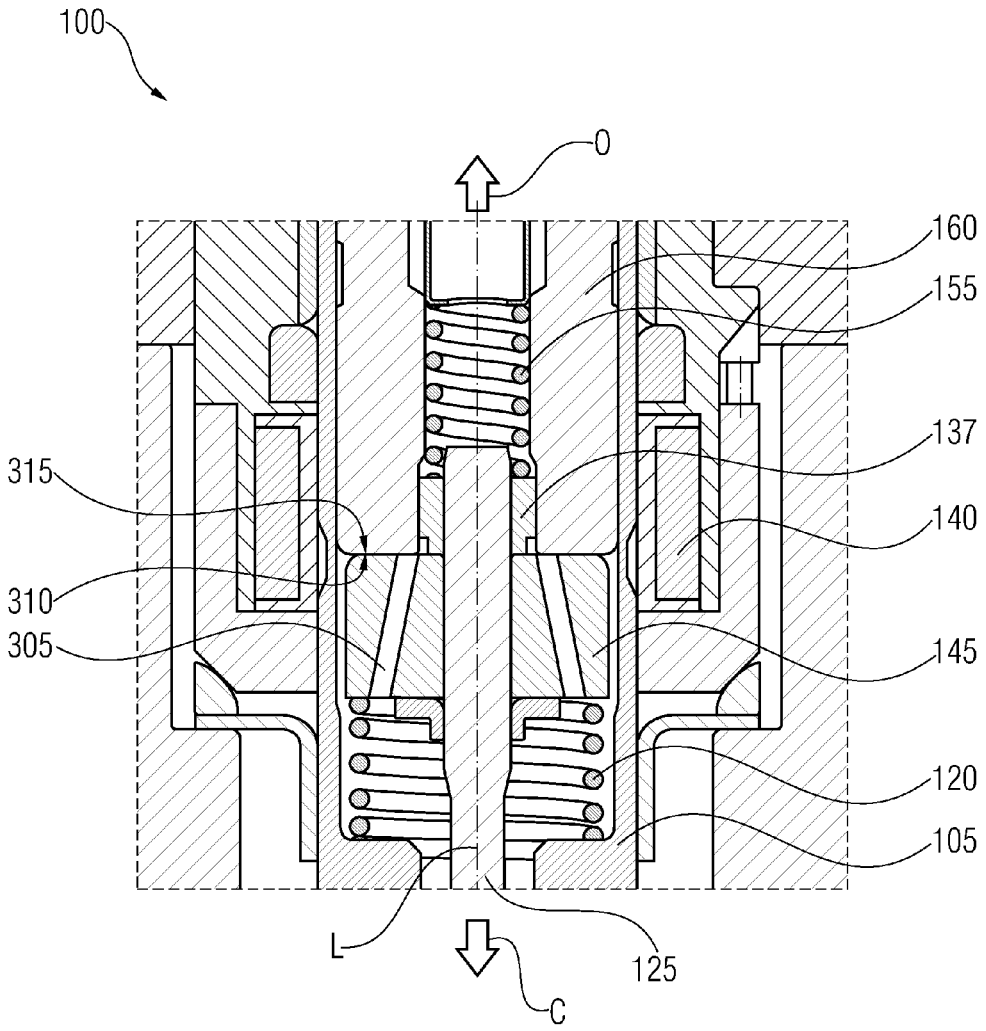
FIG. 3 shows a detail of the fuel injector of FIG. 1 in a preferred embodiment.

FIG. 1 shows a fuel injector 100 according to an exemplary embodiment of the present invention in a longitudinal section view. FIG. 3 shows a detail of the fuel injector 100 of FIG. 1.

The fuel injector 100 comprises a housing 105. A fuel valve 110 is arranged at a fuel outlet end of the housing 105. Further, the fuel injector 100 comprises an electromagnetic actuator 115.

The fuel valve 110 comprises a valve needle 125 and a valve seat 130. In the embodiment shown in FIG. 1, the valve needle 125 has a hollow shaft through which fuel may pass. At a downstream end of the shaft a ball 135 of the valve needle 125 is fixed to the shaft.

The valve needle is displaceable relative to the housing 105 in reciprocating fashion with respect to a longitudinal axis L of the fuel injector 100 for controlling the fuel flow through the fuel injector 100. In a closing position of the valve needle 125, the ball 135 abuts the valve seat 130. In another embodiment, the valve needle 125 comprises a solid shaft which rests directly on the valve seat 130 in the closing position or to which a ball 135 is fixed in similar fashion as described above. The fuel valve 110 is configured to inhibit a flow of fuel through an injection nozzle of the fuel injector 100 when the valve needle 125 is pressed down on the valve seat 130 in a closing direction C into the closing position. For permitting fuel to pass through the fuel valve 110 and being dispensed through the injection nozzle, the valve needle 125 is lifted in an opening direction O, opposite to the closing direction C, away from the valve seat 130.

A calibration spring 155 is provided which exerts a pressing force on the valve needle 125 in the closing direction C for biasing the valve needle 125 in contact the valve seat 130. Calibration spring 155 ensures a leak-tight closing of fuel valve 110 when the electromagnetic actuator 115 is not operated and, thus, the solenoid 140 is not energized.

The electric actuator 115 of FIG. 1 comprises a solenoid 140, a pole piece 160, an armature 145, and an optional spring 120. Electrical leads of the solenoid 140 are preferably connected to a connector 150 that may be attached to the housing 105 or integrated in the housing 105. For example, the housing 105 comprises a metallic valve body and a—preferably moulded—plastic body extending circumferentially around a portion of the valve body. The connector 150 may be a section of the plastic body. When a current flows through the solenoid 140, an electromagnetic field is created that pulls the armature 145 in the opening direction towards the pole piece 160.

The armature 145 is displaceable in reciprocating fashion with respect to the valve seat 130, i.e. with respect to the housing 105, along the longitudinal axis L. The valve needle 125 is engaged or engageable with the armature 145 such that said movement of armature 145 effects an opening of the fuel valve 110.

Embodiments, in which the armature 145 is positionally fix with respect to the valve needle 125 are conceivable. For example, the armature 145 can be in one piece with the valve needle 125, or it can be press-fitted and/or welded to the valve needle 125. In the present embodiment, however, the armature 145 is displaceable relative to the valve needle 125 in reciprocating fashion along the longitudinal axis L. The valve needle 125 comprises an armature retainer 137 which is operable to limit the axial displaceability of the armature 145 relative to the valve needle 125 in the opening direction O. For example, the armature retainer 137 is represented by a collar of the valve needle 125 (as exemplary shown in FIG. 1) or the armature retainer 137 is a separate part which is fixed to the shaft of the valve needle 125 (as exemplary shown in FIG. 3). The armature 145 and the armature retainer 137 overlap laterally so that the armature 145 is operable to establish a form-fit engagement with the armature retainer 137.

The spring 120 is disposed between the housing 105 and the armature 145 and biases the armature 145 in a direction towards the armature retainer 137. In this way, the armature 145 is in engagement with the valve needle 125 when the actuator 115 is energized to initiate the opening transient. Alternatively, the fuel injector 100 can be configured to retain the armature 145 spaced apart from the armature retainer 137 at the beginning of the opening transient so that the armature travels a predetermined distance with respect to the valve needle (125)—a so-called "free-lift"—at the beginning of the opening transient, before engaging with the armature retainer 137.

A pole piece 160 is situated on an axial side of armature 145 that faces towards the armature retainer 137. When the solenoid 140 is energized, the armature 145 is attracted towards the pole piece 160. By means of the engagement of the armature 145 with the valve needle 125, the actuator 115 is operable to transfer a lifting force to the valve needle 125 for lifting the valve needle 125 from the valve seat 130 to a fully open position against the pressing force of the calibration spring 155.

In conventional fuel injectors, the pole piece 160 functions as a stopper which determines an upmost position of the armature 145, that is the position where armature 145 is furthest away from valve 110 and needle lift at the valve 110 is maximised. In other words, the movement of the armature 145 is stopped by abutting the pole piece 160 at the end of the opening transient.

Figure 2:
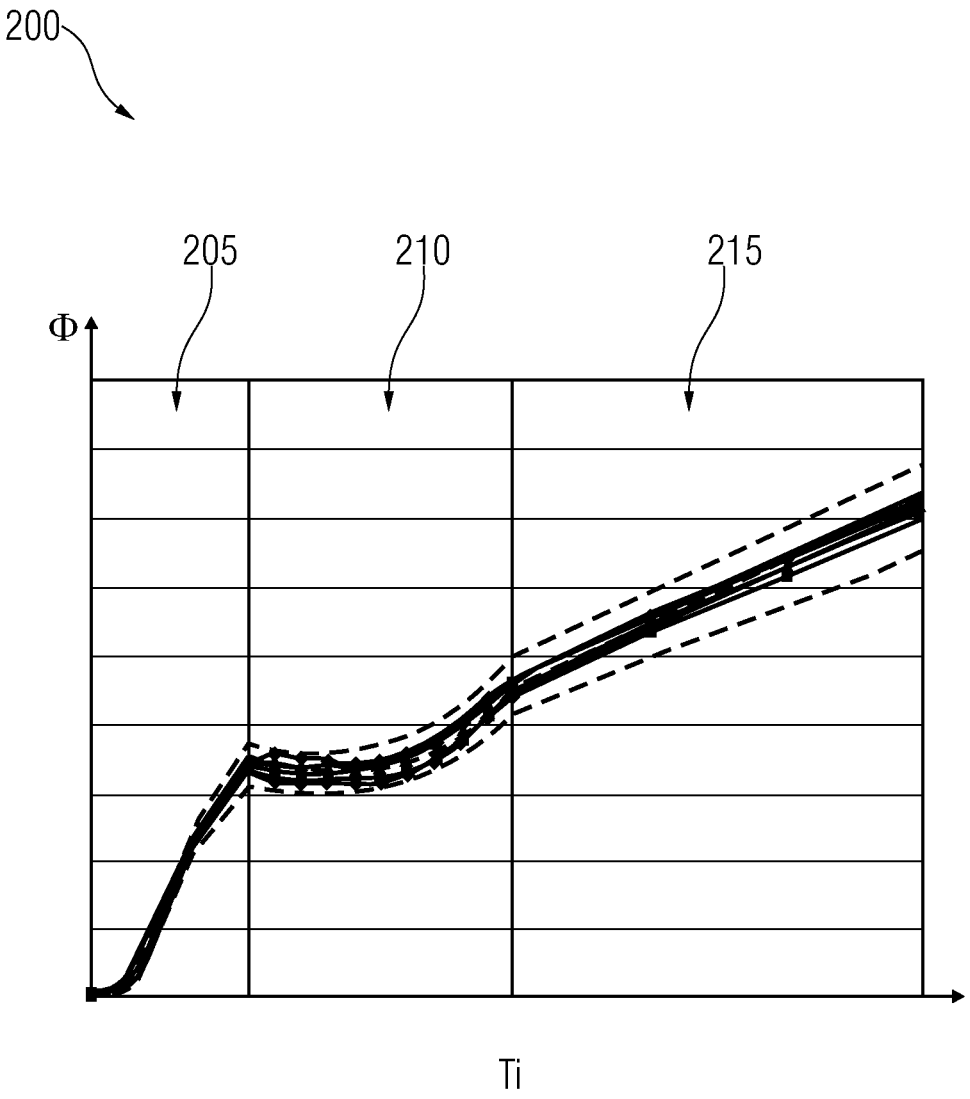
FIG. 2 shows a schematic relationship between pulse time and fuel flow through conventional injectors.

FIG. 2 shows a schematic relationship 200 between pulse time and fuel flow Φ through several exemplary conventional injectors. In horizontal direction, a pulse length Ti for energizing the solenoid 140 is shown. On the vertical axis, a flow through an injector 100 is shown.

In a ballistic area 205, the solenoid 140 is de-energized after such a short pulse length that the valve 110 never reaches its fully open position. Opening and closing times are repeatable but the injection is not fully stabilized and the injection is limited to small fuel doses.

As the pulses become longer, the conventional injectors enter into a non-linear flow area 210 in which the valve 110 reaches its maximum opening position. The lifting force of the actuator 115 is much larger than the pressing force of the calibration spring 155. This may contribute to the impact of the armature 145 against the stopper 160 causing the flow dynamics not to be stabilized.

With even longer pulses, in a linear area 215, the flow can be stabilized and the mechanical transient is ended and in a steady state. Repeatability, however, may be degraded due to unpredictable behaviour while passing the ballistic area 205 and/or the linear area 210 during the injection event (roughly indicated by the dashed lines in FIG. 2).

The ideal flow curve would be monotonic with only a ballistic area 205 and a linear area 215. The bigger the non-linear area 210 is in a conventional fuel injector, and the more the relationship between pulse length and flow differs from a linear relationship, the smaller is the range of pulse lengths which can be used to feed the engine. The unsatisfactory reproducibility of the injected doses in the non-linear area 210 may have an adverse impact on the fuel consumption of the engine, e.g. due to constraints for controlling the fuel injector.

According to the one embodiment, the calibration spring 155 and the electromagnetic actuator 115 are configured such that the lifting force equals the pressing force in the fully open position of the valve needle 125.

For opening the fuel valve 110, the actuator assembly 115 is energized by feeding an electrical operating current to the solenoid 140. The magnetic field thus generated by the solenoid 140 attracts the armature 145 towards the pole piece 160. The armature therefore moves from a start position, remote from the pole piece 160, to an end position, proximate to the pole piece 160, in the opening direction O.

During its travel from the start position to the end position, the armature is in form-fit engagement with the armature retainer 137 of the valve needle 125. In this way, the actuator 115 transfers a lifting force to the valve needle 125 so that the valve needle 125 is moved from its closing position to the fully open position in the opening direction O against the bias of the pressing force exerted by the calibration spring 155. The valve needle 125 leaving the closing position coincides with the armature 145 leaving the start position. The valve needle 125 reaching the fully open position coincides with the armature 145 reaching the end position.

At the end position and the fully open position, respectively, the armature 145 and the valve needle 125, respectively come to a rest. It is conceivable that the armature 145—and in particular the valve needle 125 with it—overshoot the fully open position and perform damped oscillations before finally coming to a rest.

When the solenoid 140 is de-energized, the calibration spring 155 pushes the valve needle 125 back in the closing direction C towards the closing position. By means of the form-fit engagement with the armature retainer 137, the valve needle 125 takes the armature 145 with it in the closing direction C until the ball 135 rests on the valve seat 130.

In this moment, the armature can disengage from the form-fit engagement with the armature retainer 137 due to its axial displaceability relative to the valve needle 125 and move further in the closing direction C relative to the valve needle 125 and to the valve seat 130. In this way, the risk for a bouncing of the valve needle 125—which may cause re-opening of the fuel valve 110—is particularly small. The armature is subsequently pushed back into contact with the armature retainer 137 by the spring 120.

It is mainly the pressing force of the calibration spring 155 in the closing direction C and the electromagnetic force from the solenoid 140 in the opening direction O which contributes to balance the armature 145 in its end position when the valve 110 is fully open. In the present embodiment, the spring force of the spring 120 may add to the lifting force in addition to the electromagnetic force in the opening direction O.

The armature 145 is further displaceable in the opening direction O from the end position. In other words, the axial displaceability of the armature 145 with respect to the housing 105 and the valve seat 130 is not limited at the end position (except for the force equilibrium between the lifting force and the pressing force), in particular not by mechanical contact with the housing 105 or another component of the fuel injector 100 which is positionally fix with respect to the housing, such as the pole piece 160. Rather, in the end position, the armature 145 is "suspended", as a small displacement to or away from the valve seat 130 will cause opposing forces to increase so that the armature 145 is returned to its previous position. Preferably, the calibration spring 155 is configured with a stiffness which is sufficient to keep the armature 145 from impacting on the pole piece 160 when the solenoid 140 is actuated and its magnetic fields pulls the armature 145 up and away from the valve seat 130 to permit a flow of fuel through the injector 100.

It is preferred that the armature 145 is immersed in a liquid, particularly the fuel for flowing through the injector 100. In one embodiment which is shown in FIG. 3, one or more holes 305 are provided in armature 145 to facilitate fuel flowing towards the valve 110.

A first surface 310 of the armature 145 and a second surface 315 of the pole piece 160 are facing towards each other, i.e. the two surfaces 310, 315 lie on opposing sides of an axial gap that is preferably filled with fuel. In a conventional injector 100, an impact between first and second surfaces 310, 315 defines the end position of the armature 145. According to one embodiment, the first and second surfaces 310, 315 are kept separate at all times, especially while the solenoid 140 is energized and the armature 145 has moved furthest towards the stopper 160.

It is preferred that the surfaces 110 and 115 are in parallel. Particularly when a space between the surfaces 310 and 315 is hydraulically connected to a path of the fuel to the injector 100, a damping effect to the movement of armature 145 can be induced to the surfaces 310, 315. As the surfaces 310, 315 approach each other, the space between them becomes smaller and fluid is displaced from that space. When the surfaces 310, 315 are moved off of each other, fluid needs to enter the increasing space in order to permit said movement. Shape and size of the surfaces 310, 315 and a minimum distance between the surfaces 310, 315 may be adapted to the damping requirements. It is preferred that the surfaces 310, 315 extend in a direction perpendicular to a direction O, C of travel of the armature 145. Damping may also be affected by position, size, direction and count of holes 305.

Figure 4:
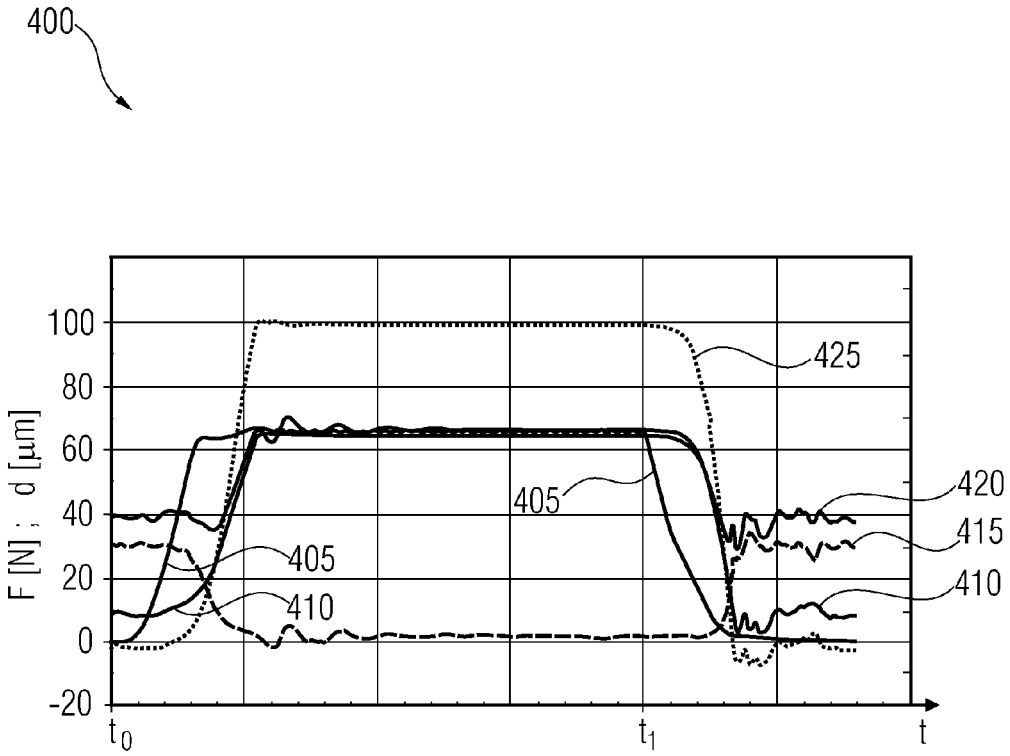
FIG. 4 shows forces over time at the fuel injector of FIG. 3.

FIG. 4 shows a diagram 400 of forces F and a needle lift d over time t of the fuel injector 100 of FIG. 3. A horizontal direction shows time t and a vertical direction shows force F and needle lift d. Numeric specifications are only exemplary.

Diagram 400 shows a magnetic force 405 that is exerted by solenoid 140. Magnetic force 405 is representative for the lifting force transferred to the valve needle 125 by the actuator 115. Further, a spring force 410 is shown in diagram 400 that is exerted by calibration spring 155 and corresponds to the pressing force described above. Finally, a hydraulic force 415 is shown that is the result of different hydraulic pressures inside and outside the fuel valve 110.

A total external force 420 is the sum of the spring force 410 and the hydraulic force 415. As a reference, a needle lift 425 shows how far the ball 135 the valve needle 125 of the valve needle 125 has been lifted from the valve seat 130.

The needle lift 425 shows an early and steady increase after beginning to energize solenoid 140 at a time t0. After rising to a maximum elevation, the needle lift 425 stays steady and drops quickly when the solenoid 140 is no longer energized at time t2.

The total external force 420 is always closely equal to the magnetic force 405 due to the load of the calibration spring 155 which increases during the opening phase and compensates the reduction of hydraulic force 415.

Figure 5:
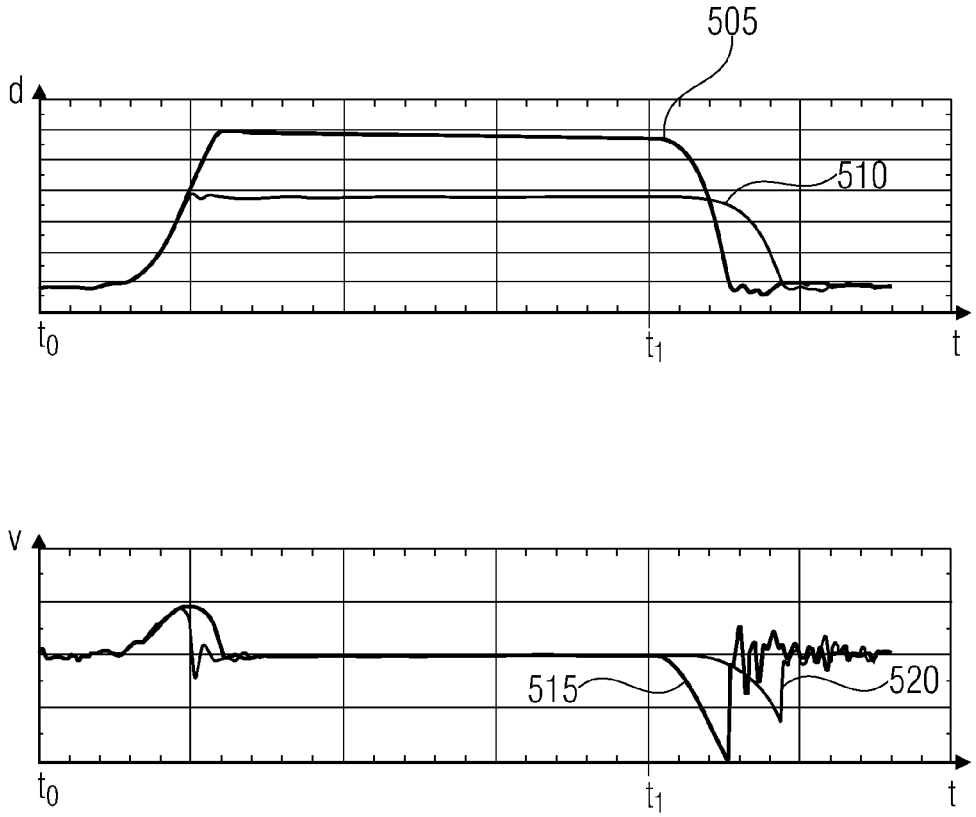
FIG. 5 shows valve lifts and valve velocity on different fuel injectors.

FIG. 5 shows an upper diagram of valve lift and a lower diagram of valve velocity. In both cases, movement of the armature 145 is represented. A horizontal direction shows time t and a vertical direction shows lift d in the upper section and velocity v in the lower section of FIG. 5.

A first line 505 in the upper section shows the lift of the injector 100 according to the embodiment discussed with respect to FIGS. 1 and 3 and a second lift 510 shows a corresponding lift of a conventional injector in which travel of armature 145 is limited by an impact on the stopper 160. In the lower section of FIG. 5, a first velocity 515 corresponds to the first lift 505 and a second velocity 520 corresponds to the second lift 510 in the upper section of FIG. 5.

The solenoid 140 is energized around a time t0. While the first lift 505 firstly rises with about the same steepness as the second lift 510 after energizing, it takes the first lift 505 a little longer to reach its extreme position, where it provides a higher absolute lift than the second lift 510. Notably, the first lift 505 does not exhibit "wiggles" as the second lift 510 does at the transition to the extreme position—which extreme position corresponds to the end position of the armature 145 described above. Such wiggles, however, may indicate disadvantageous non-linear behaviour of the fuel injector.

Upon de-energizing solenoid 145 at time t1, a first lift 505 decreases sooner and faster than the second lift 510. During closing, the absolute first speed 520 of armature 145 reaches a higher absolute value than the second speed 520 of the conventional fuel injector 100.

What is claimed is:

1. A fuel injector, comprising:

a fuel valve comprising a valve seat and a movable valve needle that cooperate for controlling a flow of fuel through the injector;

a calibration spring; and an electromagnetic actuator comprising a solenoid and a movable armature;

wherein the calibration spring exerts a pressing force on the valve needle for pressing the valve needle in a closing direction towards the valve seat;

wherein when the solenoid is electrically energized, the electromagnetic actuator transfers a lifting force to the valve needle by engagement with the armature to lift the valve needle from the valve seat to a fully open position against the pressing force of the calibration spring; and wherein the calibration spring and the electromagnetic actuator are configured such that the lifting force equals the pressing force in the fully open position.

2. The fuel injector according to claim 1, wherein the armature is displaceable in an opening direction, opposite to the closing direction, from a start position to an end position for lifting the valve needle from a closing position to the fully open position, and wherein the armature is further displaceable in the opening direction from said end position.

3. The fuel injector according to claim 2, wherein the displacement of the armature between the start position and the end position is greater than 90 μm.

4. The fuel injector according to claim 1, wherein the calibration spring has a stiffness of 400 N/mm or more.

5. The fuel injector according to claim 1, further comprising a stopper arranged such that the stopper is approached by the armature upon the opening motion of the armature, wherein the stopper and the armature have facing surfaces that are parallel to each other.

6. The fuel injector according to claim 5, wherein the surfaces are perpendicular to a direction of the opening motion of the armature.

7. The fuel injector according to claim 5, wherein a gap between the facing surfaces is hydraulically connected to a path of the fuel through the injector towards the valve.

8. The fuel injector according to claim 1, wherein the armature is displaceable in an opening direction, opposite to the closing direction, from a start position to an end position for lifting the valve needle from a closing position to the fully open position, and wherein the armature is further displaceable in the opening direction from said end position, wherein the fuel injector further comprises a stopper arranged such that the stopper is approached by the armature upon the opening motion of the armature, wherein the stopper and the armature have facing surfaces that are parallel to each other, and wherein the facing surfaces are separated from each other when the armature is in the end position.

9. The fuel injector according to claim 1, wherein the calibration spring comprises a spring sleeve.

10. An internal combustion engine, comprising:

a plurality of fuel injectors, each comprising:

a fuel valve comprising a valve seat and a movable valve needle that cooperate for controlling a flow of fuel through the injector;

a calibration spring; and an electromagnetic actuator comprising a solenoid and a movable armature;

wherein the calibration spring exerts a pressing force on the valve needle for pressing the valve needle in a closing direction towards the valve seat;

wherein when the solenoid is electrically energized, the electromagnetic actuator transfers a lifting force to the valve needle by engagement with the armature to lift the valve needle from the valve seat to a fully open position against the pressing force of the calibration spring; and wherein the calibration spring and the electromagnetic actuator are configured such that the lifting force equals the pressing force in the fully open position.

11. The internal combustion engine according to claim 10, wherein for each fuel injector, the armature is displaceable in an opening direction, opposite to the closing direction, from a start position to an end position for lifting the valve needle from a closing position to the fully open position, and wherein the armature is further displaceable in the opening direction from said end position.

12. The internal combustion engine according to claim 11, wherein the displacement of the armature between the start position and the end position is greater than 90 μm.

13. The internal combustion engine according to claim 10, wherein for each fuel injector, the calibration spring has a stiffness of 400 N/mm or more.

14. The internal combustion engine according to claim 10, wherein each fuel injector further comprises a stopper arranged such that the stopper is approached by the armature upon the opening motion of the armature, wherein the stopper and the armature have facing surfaces that are parallel to each other.

15. The internal combustion engine according to claim 14, wherein the surfaces are perpendicular to a direction of the opening motion of the armature.

16. The internal combustion engine according to claim 14, wherein a gap between the facing surfaces is hydraulically connected to a path of the fuel through the injector towards the valve.

17. The internal combustion engine according to claim 10, wherein for each fuel injector:

the armature is displaceable in an opening direction, opposite to the closing direction, from a start position to an end position for lifting the valve needle from a closing position to the fully open position, and wherein the armature is further displaceable in the opening direction from said end position, the fuel injector further comprises a stopper arranged such that the stopper is approached by the armature upon the opening motion of the armature, wherein the stopper and the armature have facing surfaces that are parallel to each other, and the facing surfaces are separated from each other when the armature is in the end position.

18. The internal combustion engine according to claim 10, wherein for each fuel injector, the calibration spring comprises a spring sleeve.

* * * * *